United States Patent [19]

Ruggles et al.

[11] Patent Number: 4,908,915

[45] Date of Patent: Mar. 20, 1990

[54] METAL CLIP FOR ATTACHING METAL STUD SYSTEM TO A CEILING GRID SYSTEM

[76] Inventors: Donald L. Ruggles, 1235 Winespring La., Towson, Md. 21204; Arthur G. Maben, 4202 Wilkens Ave., Baltimore, Md. 21229

[21] Appl. No.: 242,491

[22] Filed: Sep. 9, 1988

[51] Int. Cl.[4] ..... E04H 1/00

[52] U.S. Cl. ..... 24/336; 24/339; 52/665; 52/714

[58] Field of Search ..... 24/336, 329, 340, 335, 24/339, 504; 52/665, 714, 473

[56] References Cited

U.S. PATENT DOCUMENTS

| | | | |
|---|---|---|---|
| 616,525 | 12/1898 | Coon | 24/336 |
| 796,468 | 8/1905 | Streeter | 52/665 |
| 1,774,775 | 9/1930 | Weitz, Jr. | 24/339 |
| 2,723,431 | 11/1955 | Renzo | 24/339 |
| 3,033,412 | 5/1962 | Fox | 24/339 |
| 3,899,857 | 8/1975 | Mochizuki | 52/665 |
| 3,907,239 | 9/1975 | Ehrlich | 24/339 |
| 4,073,108 | 2/1978 | Williams | 52/714 |

FOREIGN PATENT DOCUMENTS

| | | | |
|---|---|---|---|
| 0785300 | 10/1957 | United Kingdom | 24/339 |

*Primary Examiner*—Victor N. Sakran
*Attorney, Agent, or Firm*—Walter G. Finch

[57] ABSTRACT

This invention provides several embodiments of a metal clip which is snapped onto a grid system and which anchors it through to place on a metal stud wall system. These metal clips makes it possible to erect metal studs of a housing and/or office construction without using electricity and without damaging the grid system so that the former can be removed and the ceiling of the construction does not have to be patched and/or replaced. In one embodiment of the metal clip, the metal clip has a pair of downwardly extending spaced spring sides connected together by a flat section. The spring sides are positioned over a cross metal beam and/or track. An upwardly extending clip is attached to the flat section and positioned in a fixed position for coupling of the grid system. In a second embodiment, the upwardly extending clip is made rotatable to connect to the grid system in different positions. In still another embodiment of the metal clip, it is formed with two substantially parallel sides located in substantially the same plane, and with vertically extending sides positioned at the ends of said sides for gripping the grid system.

11 Claims, 4 Drawing Sheets

METAL CLIP FOR ATTACHING METAL STUD SYSTEM TO A CEILING GRID SYSTEM

BACKGROUND AND SUMMARY OF THE INVENTION

This invention relates to novel metal clips for attaching metal track and studs to a ceiling grid system, and more particularly to an inexpensive and economical metal clip that can be utilized in mass construction of removable and/or replaceable walls.

In a conventional top track of a metal stud wall, the wall in the past has been screwed into and through the grid system. Consequently, when you moved the wall, there were holes and/or apertures in the grid that had to be patched and/or replaced. This meant an expensive ceiling job if you just wanted to move a wall.

If it was desired to put up a wall system any other way, as in the past, electricity was required to operate the necessary tools.

A new method has been developed for erecting the metal studs of a construction without using electricity and without damaging the grid system. The metal stud system is to be removed and with the ceiling of the construction not having to be patched and/or replaced.

This is accomplished by devising a metal clip that will snap onto a grid system and anchor it through the top plate of a metal stud wall system.

SUMMARY OF THE INVENTION

This invention provides a metal clip that will snap onto a grid system and anchor it through a top plate of a metal stud wall system.

It is an object of this invention to provide a new method for erecting metal studs of a office and/or housing construction without using electricity and without damaging the grid system so that the former can be removed and the ceiling of the construction does not have to be patched and/or replaced.

And another object of this invention is to provide a metal clip system for a wall grid system that does not require the use of electrical appliances.

It is still another object of this invention to provide a metal clip which is easily affixed to a wall grid system.

And still another object of this invention is to provide a metal clip system for a panel grid system which is economical to manufacture, and which is efficient and reliable in operation, and, additionally, which is easy to assemble in the grid system, and to disassemble from the system.

Another object of this invention is to provide a metal clip that attaches the top track of the metal stud system to the grid system.

BRIEF DESCRIPTION OF THE DRAWINGS

These and other objects and advantages of the invention will be more readily apparent when considered in relation to the preferred embodiments as set forth in the specification and shown in the drawings in which.

DESCRIPTION OF THE PREFERRED EMBODIMENTS

Figure 1:
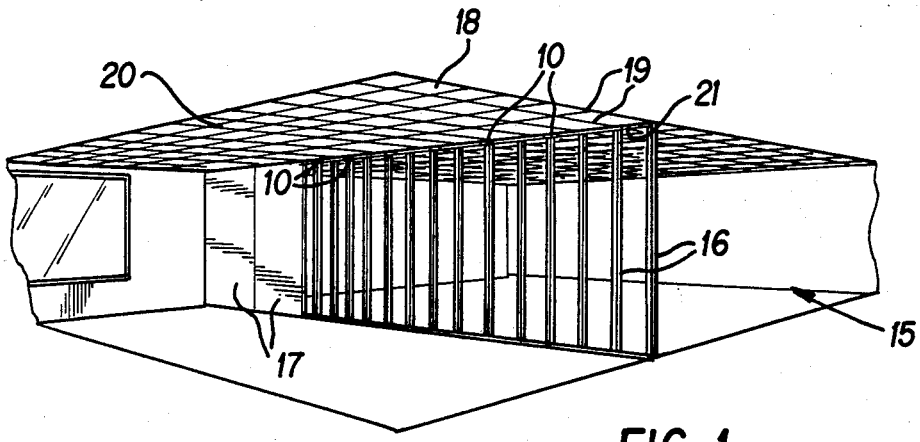
FIG. 1 is a perspective view of a construction, such as an office, showing metal studs in position to create an interior wall.
Figure 2:
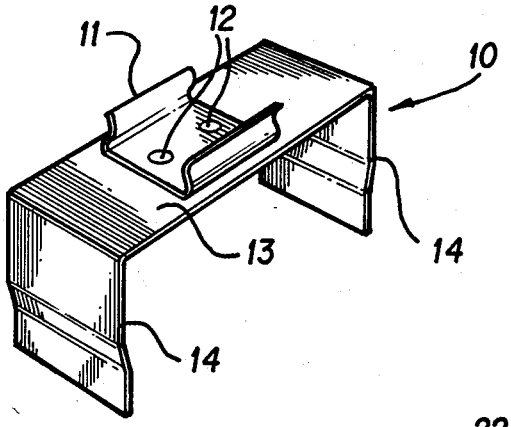
FIG. 2 is a perspective view of a first embodiment of a novel metal clip incorporating features of this invention.

Now referring to FIGS. 1 and 2, there is shown a metal clip system 10 for attaching a clip 11, for example, an office and/or large room 15 to the upper ends of metal studs 16. Dry wall 17 are provided, as well as a roof of ceiling tile 18 and tile supports 19. A drop ceiling 20 is provided in the office and/or room 15, together with metal cross beam, all as shown in FIG. 1. Reference numeral 21 is illustrative of a track, and is the top and bottom member of the stud system and holds the studs in place.

The metal clip 10 has a pair of vertical spaced sides 14, with a fastening portion clip 11 located therebetween. The clip 11 has a pair of bent side walls connected by a flat plate and a pair of rivets 12 are used to fasten the upper clip to the fastening portion 13.

Figure 3:
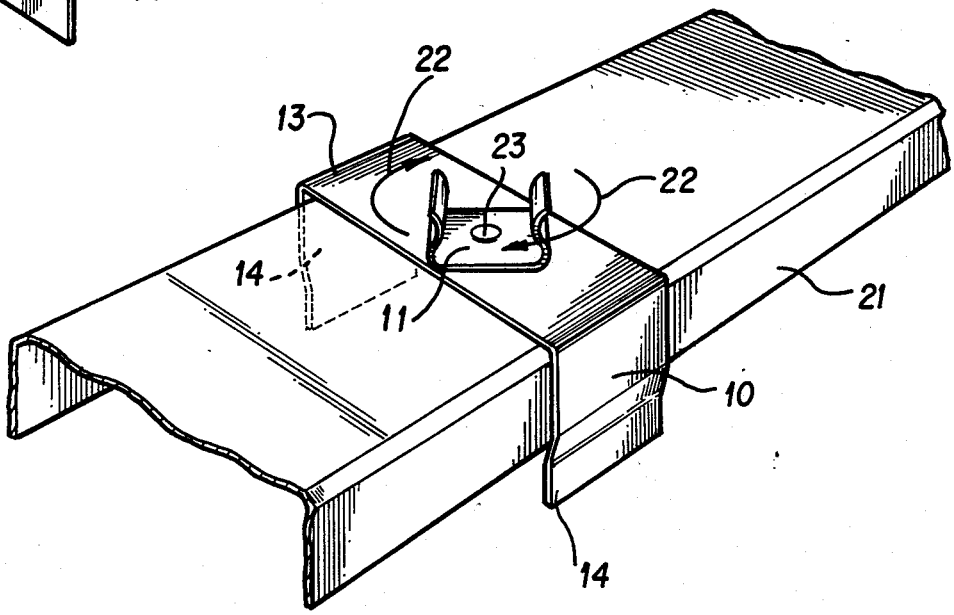
FIG. 3 is a perspective view of a second embodiment of a novel metal clip attached to a metal cross beam and rotatable to form an angular wall.

FIG. 3 shows the same clip 10 of FIG. 2, only the clip can be changed in different angles, that is changed in different directions and arranged to swivel, so that the metal clip 10 does not have to run it parallel with the grid system.

The metal cross beam is engaged by the sides 14 of the fastening clip 10. A rivet 23 is utilized to attach the upper clip 11, and the direction of rotation is shown by reference numeral 22.

Figure 4:
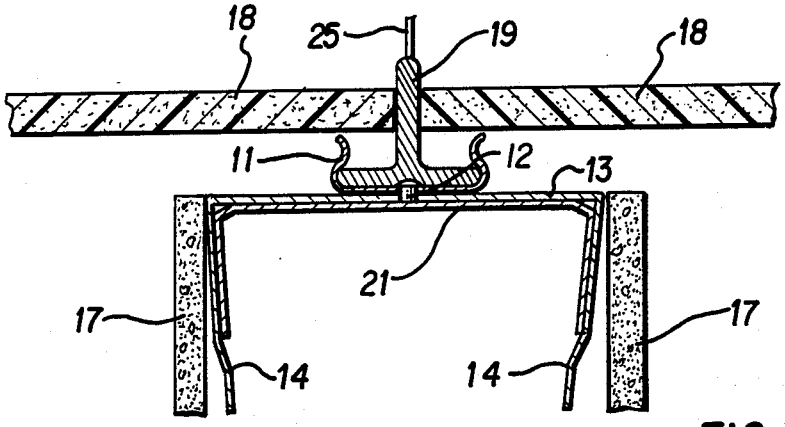
FIG. 4 is a cross section of a metal clip of this invention in a fixed position.

FIG. 4 shows a cross-section of the metal clip 11 described in connection with FIG. 3, and the positioning of the clip 11 to the ceiling grid 19. The rivet 12 is attached to the fastening portion 13 of the clip 10. The sides 14 of the fastening portion are positioned between the dry walls 17. The tile supports 19 extend through the ceiling tile.

Figure 5:
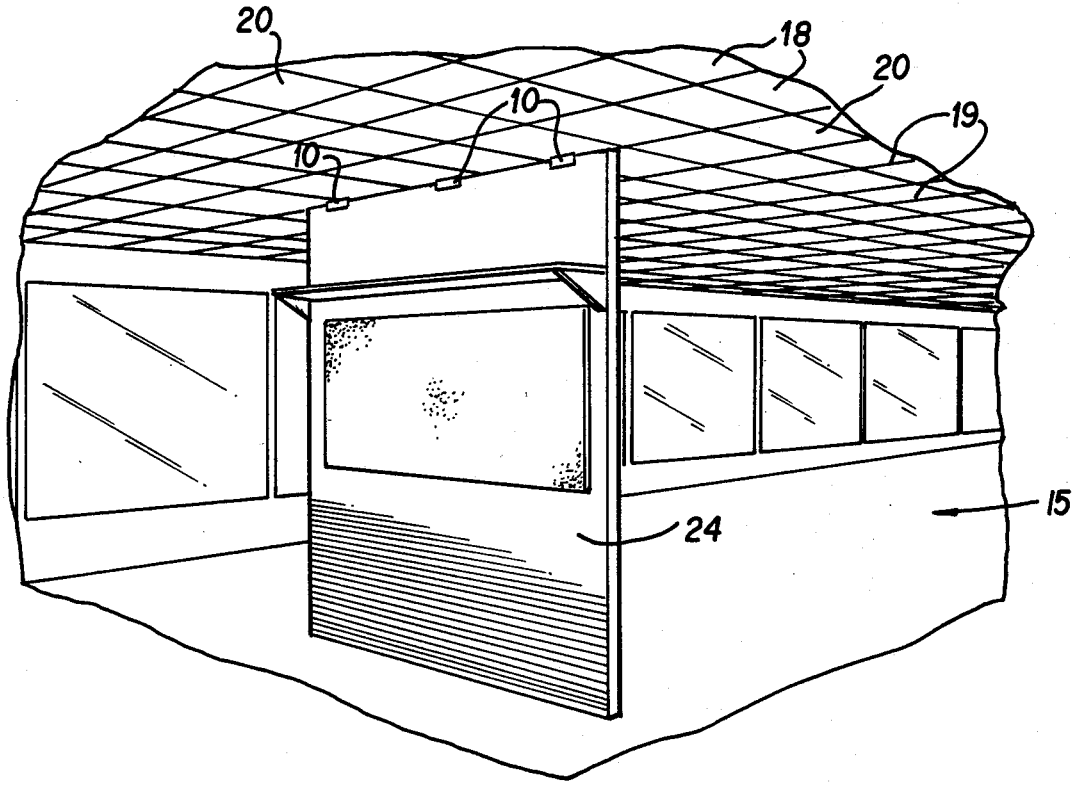
FIG. 5 is a perspective view of the metal clip being used to support a ready made wall divider.

FIG. 5 shows a construction having an office and/or large room 15 having the metal clips 10 as previously described, the ceiling tile 18, the tile supports 19, the drop ceiling 20, and the front panel 24 of the office and/or large room 15.

Figure 6:
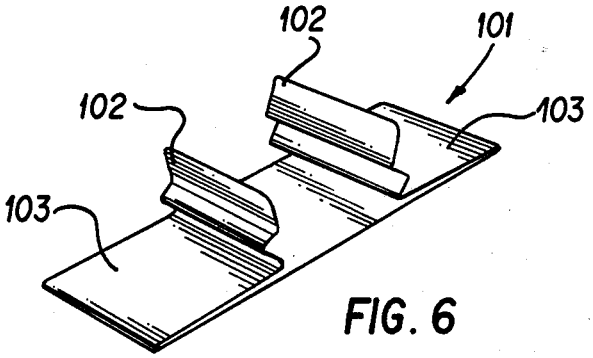
FIG. 6 is a perspective view of a third embodiment of a novel metal clip incorporating features of the invention.

The metal clip 101 of FIG. 6 is another type of clip that does the same performance of the earlier described metal clips 10. It has the two end walls 103 and the vertically arranged members 102.

Figure 7:
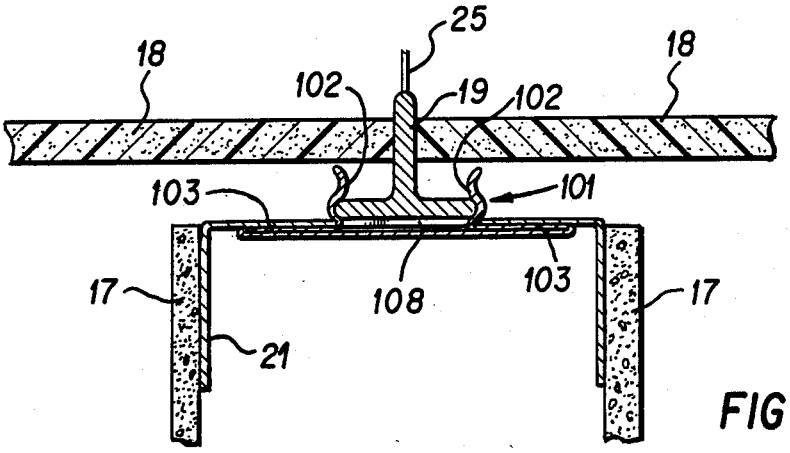
FIG. 7 is a cross section of the metal clip of FIG. 6 in a fixed position.

This clip 101 has the advantages that it is much smaller, the manufacturing, packaging and handling is easier. This clip 101 would have to have a hole in the track in order to use this metal clip 101, but this clip 101 is a better clip than the other clip because it is so much smaller. In FIG. 7, the metal clip 101 is shown positioned in a ceiling tile 18 having the vertical sides 102 of the clip 101, the extending sides 103 and the tile support 19.

FIG. 7 shows a T-track, a metal ceiling track that is in a T-shape and this clip just snaps overtop of the edges. This would be reference numeral 21 which shows a metal track. Track 21 for metal stud wall system, having a hole 108 in it.

Figure 8:
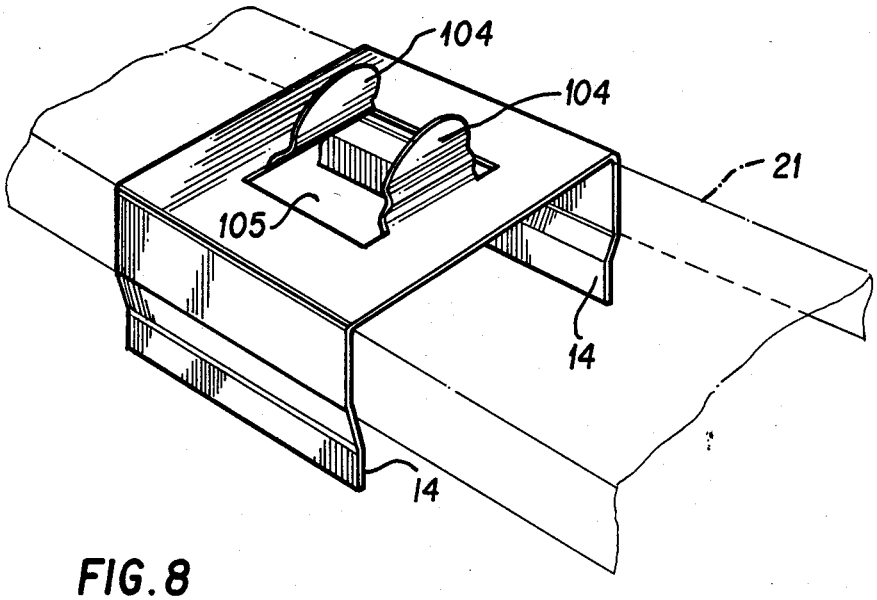
FIG. 8 is a perspective view of a fourth embodiment of a metal clip corresponding to the rotatable clip of FIG. 3.

FIG. 8 is another clip. It is another form of attachment of the metal study system to the grid ceiling system and this is, instead of the part that holds the wall and track grid system together, instead of them being two separate pieces and connected with a ribbot, this is stamped out of one-piece and it is simply bent and folded over so that it does the same job as the clips on FIGS. 1–5.

The clip is rotatable, that is, it will face either east and west or north and south, either way. Thus the tabs 104 can be rotated 90 from the position shown in FIG. 8.

Figure 9:
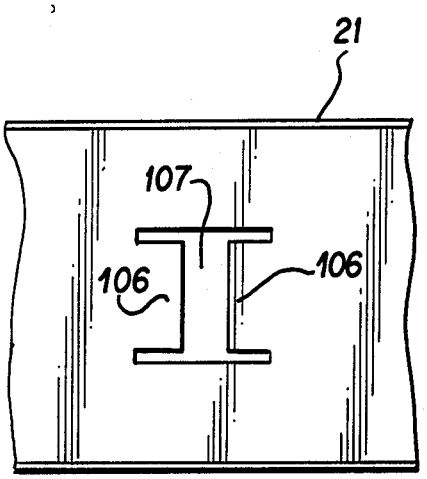
FIG. 9 is a plan view of a metal cross beam showing vertical positioning of H slot for a clip.
Figure 10:
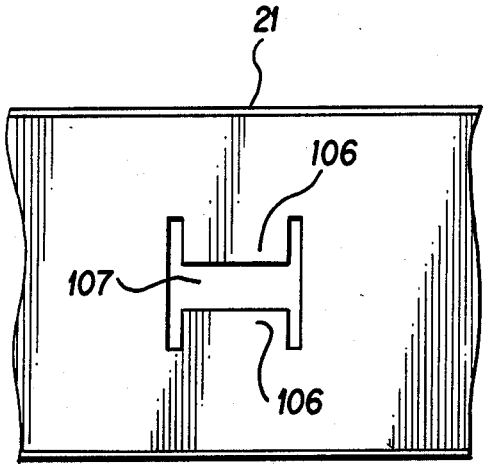
FIG. 10 is a plan view of a metal track showing H positioning to a clip positioning 90 to FIG. 9.
Figure 11:
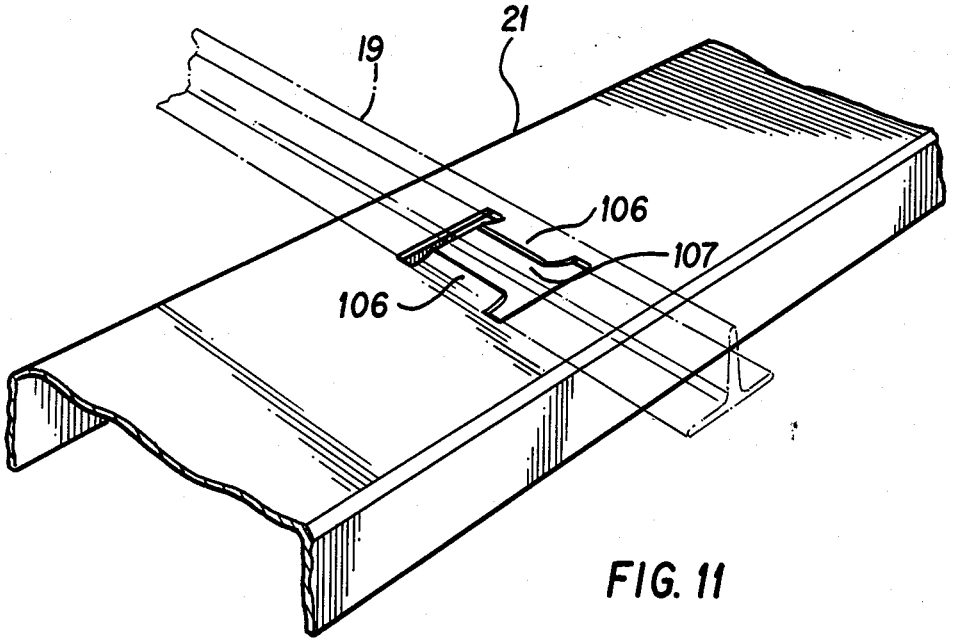
FIG. 11 is a perspective view of a title support tee and a metal track cross beam.

FIGS. 9 to 11 is another embodiment of a metal clip. The stud manufacturers would have to notch their metal track. The notch could be bent up and then bent over again onto the grid system ceiling T. This would then do the same job as all the other clips. It is just another way of doing it.

Having completed a detailed disclosure of the preferred embodiments of our invention so that those skilled in the art may practice the same, we contemplate that variations may be made without departing from the essence of the invention or the scope of the appended claims.

What is claimed is:

1. A metal clip system for a grid structure, comprising, at least two clip means, one of said clip means having a first central section terminating in opposite ends and a pair of end sections extending downwardly from said opposite ends of said first central section, each of said end sections being formed of first, second, and third portions, with said first portion being formed adjacent said central section, said first and third portions being substantially planar and arranged parallel to but offset from each other and joined together by said second portion at an angle to said first and third portions, with said third portion being positioned closer to the center of said central section of said one clip means, said pair of end sections being shaped to grasp a structural member, the other of said clip means having a second central section and upwardly extending substantially flat S-shaped ends at the opposite ends of said second central section, and means for attaching said central sections together, said other clip means being used to grasp a second structural member.

2. A metal clip system for a grid structure as recited in claim 1, wherein said one of said clip means is rigidly fixed with respect to the other of said clip means.

3. A metal clip system for a grid structure as recited in claim 1, and additionally means for rotating one of said clip means with respect to the other of said clip means.

4. A metal clip system for a grid structure, comprising, at least two clip means, one of said clip means having a first section terminating in opposite ends and a pair of end section extending downwardly from said opposite ends of said first section, each of said end sections being formed of first, second, and third portions, with said first portion being formed adjacent said central section, said first and third portions being substantially planar and arranged parallel to but offset from each other and joined together by said second portion at an angle to said first and third portions, with said third portion being positioned closer to the center of said central section of said one clip means, the other of said clip means having a second central section and upwardly extending ends at the opposite ends of said second central section, and means for attaching said central sections together, said other clip means being used to hold a second structural member.

5. A metal clip system for a grid structure as recited in claim 4, wherein said one of said clip means is rigidly fixed with respect to the other of said clip means.

6. A metal clip system for a grid structure as recited in claim 4, and additionally means for rotating one of said clip means with respect to the other of said clip means.

7. A metal clip system for a grid structure, comprising, at least two clip means, one of said clip means having a first central section terminating in opposite ends and a pair of end sections extending downwardly from said opposite ends of said first central section, each of said end sections being formed of first, second, and third portions, with said first portion being formed adjacent said central section, said first and third portions being substantially planar and arranged parallel to but offset from each other and joined together by said second portion at an angle to said first and third portions, with said third portion being positioned closed to the center of said central section of said one clip means, said pair of end sections being shaped to grasp a structural member, the other of said clip means having a second central sections and upwardly extending arcuate shaped ends at the opposite ends of said second central section, and means for attaching said central section together, said other clip being used to hold a second structural member.

8. A metal clip system, comprising, at least two clip means, one of said clip means having an opening central section terminating in opposite ends and a pair of end sections extending upwardly from said opposite ends of said first opening central section, each of said end sections being formed of first, second, and third portions, with said first portion being formed adjacent said central section, said first and third portions being substantially planar and arranged parallel to but offset from each other and joined together by said second portion at an angle to said first and third portions, with said third portion being positioned closer to the center of said central section of said one clip means, said pair of end sections being shaped to grasp a structural member, the other of said clip shaped spring means having a second central section and downwardly extending arcuate ends at the opposite ends of said second central section, said other clip means being used to grasp a second structural member.

9. A metal clip system for a grid structure as recited in claim 8, wherein said one of said clip means is rigidly fixed with respect to the other of said clip means.

10. A metal clip system for a grid structure as recited in claim 8, wherein said one of said clip means is rotatably mounted with respect to the other of said clip means.

11. A metal clip system for a grid structure as recited in claim 8, and means for holding said central sections together.

* * * * *